US006178776B1

(12) United States Patent
Mahoney et al.

(10) Patent No.: US 6,178,776 B1
(45) Date of Patent: Jan. 30, 2001

(54) CRYOGENIC INDIRECT OXYGEN COMPRESSION SYSTEM

(75) Inventors: Kevin William Mahoney, Amherst; Dante Patrick Bonaquist, Grand Island; Walter Joseph Olszewski, Amherst, all of NY (US)

(73) Assignee: Praxair Technology, Inc., Danbury, CT (US)

( * ) Notice: Under 35 U.S.C. 154(b), the term of this patent shall be extended for 0 days.

(21) Appl. No.: 09/429,612

(22) Filed: Oct. 29, 1999

(51) Int. Cl.[7] ..... F25J 3/00
(52) U.S. Cl. ..... 62/654
(58) Field of Search ..... 62/644, 654, 912

(56) References Cited

U.S. PATENT DOCUMENTS

| | | | |
|---|---|---|---|
| 5,255,522 | 10/1993 | Agrawal et al. | 62/22 |
| 5,265,429 | 11/1993 | Dray | 62/41 |
| 5,441,658 | 8/1995 | Boyarsky et al. | 252/67 |
| 5,546,767 | 8/1996 | Dray et al. | 62/646 |
| 5,579,654 | 12/1996 | Longsworth et al. | 62/511 |
| 5,600,970 | 2/1997 | Drnevich et al. | 62/651 |
| 5,622,644 | 4/1997 | Stevenson et al. | 252/67 |
| 5,666,828 * | 9/1997 | Howard et al. | 62/644 |
| 5,729,993 | 3/1998 | Boiarski et al. | 62/175 |

* cited by examiner

*Primary Examiner*—Corrine McDermott
*Assistant Examiner*—Malik N. Drake
(74) *Attorney, Agent, or Firm*—Stanley Ktorides

(57) ABSTRACT

A system for producing pressurized oxygen gas from low pressure oxygen gas without the need for engaging an oxygen compressor wherein low pressure oxygen gas is condensed by indirect heat exchange with a multicomponent refrigerant fluid, passed through a liquid pump, and then vaporized against that same multicomponent refrigerant fluid.

10 Claims, 2 Drawing Sheets

CRYOGENIC INDIRECT OXYGEN COMPRESSION SYSTEM

TECHNICAL FIELD

This invention relates generally to the production of pressurized oxygen gas and more particularly to the production of pressurized oxygen gas from low pressure oxygen gas.

BACKGROUND ART

The compression of gaseous oxygen to produce pressurized oxygen gas is very expensive when compared to the cost of compression of other atmospheric gases. The cost is higher in both power consumed and in initial capital cost of the compression equipment. This high cost is due to the reactive nature of gaseous oxygen. Mechanical tolerances are set much looser for an oxygen compressor than for a nitrogen or air compressor so as to reduce the risk of a rub within the machine that could cause a fire. These looser tolerances or high clearances result in significantly reduced compressor efficiencies, on the order of six to ten percent. This lower efficiency corresponds to a higher compressor power.

The problem of high cost in the production of pressurized oxygen gas is not acute when the oxygen is produced by the cryogenic separation of air because the oxygen can be recovered as high pressure gas directly from a column, or can be taken from a column as liquid, pressurized and then vaporized. However these expediencies are not available when the oxygen is produced by a non-cryogenic air separation method such as by vacuum pressure swing adsorption.

Those skilled in the art have addressed this problem by making small, incremental improvements in oxygen compressors. Incremental improvements in centrifugal compressors have been achieved, but the gains have been modest. Positive displacement machines have been used in place of centrifugal compressors, and while they have a lower initial capital cost, the life cycle cost of such machines is higher due to increased power consumption and higher maintenance cost. In summary, improvements in such machines over the years has been only incremental, not a step change.

In the operation of a non-cryogenic oxygen plant, such as a vacuum pressure swing adsorption plant, the cost of the oxygen compressor is a significant portion of both the total capital cost and the power usage of the plant. If a significant reduction in the cost of oxygen compression can be achieved, a substantial decrease in the total cost of a non-cryogenic oxygen production plant can be attained.

Accordingly it is an object of this invention to provide an improved system for the production of pressurized oxygen gas.

It is another object of this invention to provide a system for the production of pressurized oxygen gas from low pressure oxygen gas without the need for employing an oxygen compressor.

SUMMARY OF THE INVENTION

The above and other objects, which will become apparent to those skilled in the art upon a reading of this disclosure, are attained by the present invention, one aspect of which is:

A method for producing pressurized oxygen gas comprising:

(A) condensing low pressure oxygen gas by indirect heat exchange with vaporizing multicomponent refrigerant fluid to produce low pressure oxygen liquid and vaporized multicomponent refrigerant fluid;

(B) pumping at least some of the low pressure oxygen liquid to produce pressurized oxygen liquid, and compressing the vaporized multicomponent refrigerant fluid to produce higher pressure multicomponent refrigerant fluid; and (C) vaporizing at least some of the pressurized oxygen liquid by indirect heat exchange with condensing higher pressure multicomponent refrigerant fluid to produce condensed higher pressure multicomponent refrigerant fluid and pressurized oxygen gas.

Another aspect of the invention is:

Apparatus for producing pressurized oxygen gas comprising:

(A) a heat exchanger, means for providing oxygen gas to the heat exchanger, a liquid pump, means for passing oxygen liquid from the heat exchanger to the liquid pump, and means for passing oxygen liquid from the liquid pump to the heat exchanger;

(B) a compressor, means for passing multicomponent refrigerant fluid from the heat exchanger to the compressor, and means for passing multicomponent refrigerant fluid from the compressor to the heat exchanger; and (C) means for recovering product pressurized oxygen gas from the heat exchanger.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (statewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "oxygen gas" means a gas having an oxygen concentration of at least 30 mole percent and preferably at least 90 mole percent.

As used herein, the term "oxygen liquid" means a liquid having an oxygen concentration of at least 30 mole percent and preferably at least 90 mole percent.

As used herein, the term "top condenser" means a heat exchange device that generates column downflow liquid from column vapor.

As used herein, the term "bottom reboiler" means a heat exchange device that generates column upflow vapor from column liquid.

As used herein, the term "variable load refrigerant" means a multicomponent fluid, i.e. a mixture of two or more components, in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the multicomponent refrigerant fluid is at least 10° K, preferably at least 20° K and most preferably at least 50° K.

As used herein, the term "atmospheric gas" means one of the following: nitrogen ($N_2$), argon (Ar), krypton (Kr), xenon (Xe), neon (Ne), carbon dioxide ($CO_2$), oxygen ($O_2$), carbon monoxide (CO), hydrogen ($H_2$) and helium (He).

As used herein, the term "fluorocarbon" means a compound comprising at least one fluorine atom and at least one carbon atom.

DETAILED DESCRIPTION

Figure 1:
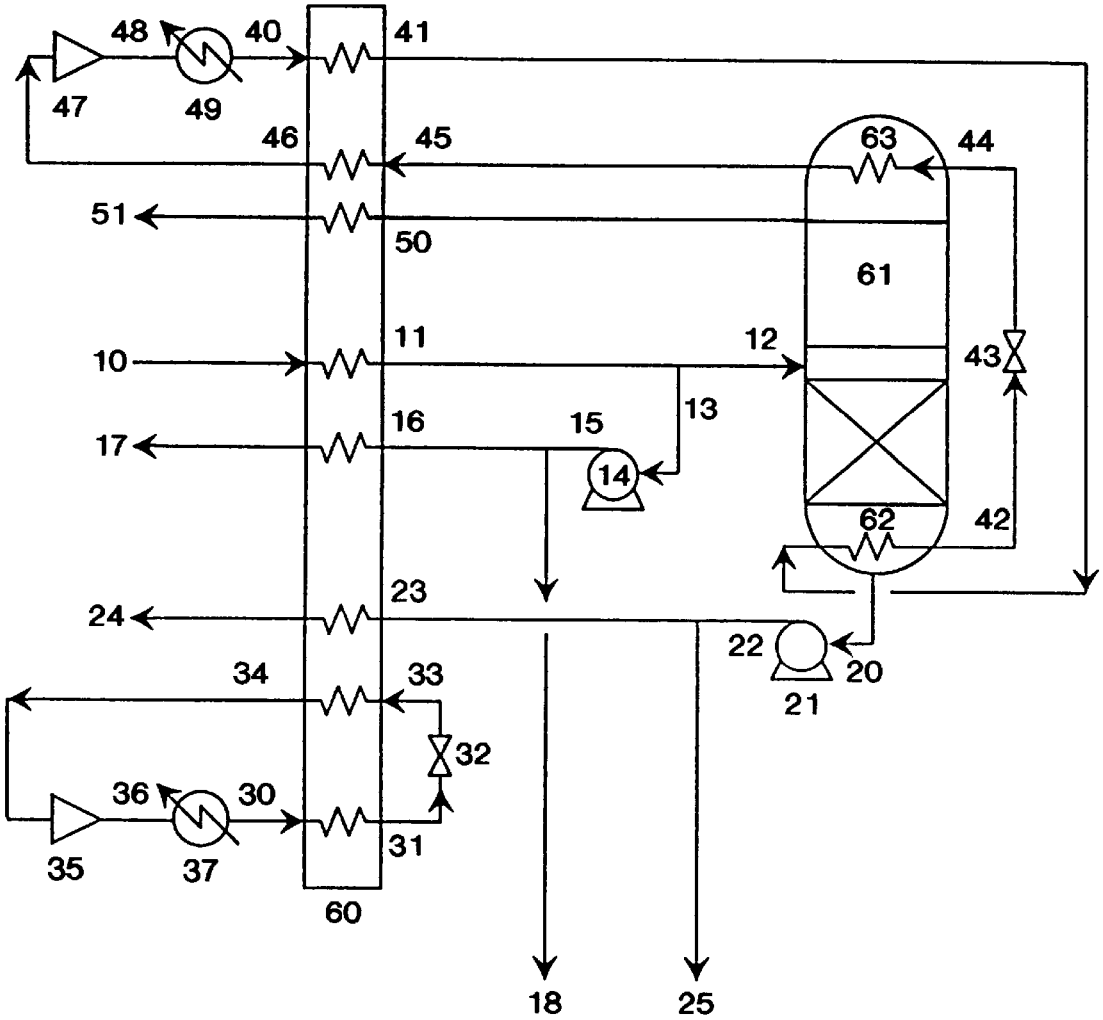
FIG. 1 is a schematic representation of one particularly preferred embodiment of the invention wherein some oxygen liquid is further processed in a cryogenic rectification column to produce higher purity oxygen.

The invention will be described in detail with reference to the Drawings. Referring now to FIG. 1, low pressure oxygen gas 10, typically at a pressure within the range of from 14.7 to 25 pounds per square inch absolute (psia), is passed to the warm end of heat exchanger 60. In the embodiment illustrated in FIG. 1, heat exchanger 60 is shown as a unitary piece. It is understood however that the heat exchanger useful in the practice of this invention could comprise two or more discrete elements. Low pressure oxygen gas in stream 10 is typically the product output from an adsorption air separation system, such as a vacuum pressure swing adsorption system, and has an oxygen concentration generally within the range of from 85 to 95 mole percent with the remainder comprised primarily of argon. Low pressure oxygen gas 10 could also be product output from a low purity oxygen cryogenic air separation plant.

Low pressure oxygen gas in stream 10 is first cooled and then condensed in heat exchanger 60 by indirect heat exchange as will be more fully discussed below. Resulting low pressure oxygen liquid exits the cold end of heat exchanger 60 as stream 11 and at least a portion 13 of stream 11 is passed to liquid pump 14 wherein its pressure is raised, generally to be within the range of from 100 to 1000 psia, more typically within the range of from 100 to 250 psia. If desired, a portion 18 of the resulting pressurized oxygen liquid from liquid pump 14 may be recovered as oxygen liquid which is typically passed to storage. The remainder 16 of the pressurized oxygen liquid is passed to the cold end of heat exchanger 60. Within heat exchanger 60 the pressurized oxygen liquid is vaporized by indirect heat exchange as will be more fully described below, resulting in the production of pressurized oxygen gas which is withdrawn from the warm end of heat exchanger 60 in stream 17 and recovered at a pressure generally within the range of from 100 to 1000 psia, more typically within the range of from 100 to 250 psia.

While the heat duty of condensing stream 10 and vaporizing stream 16 is about the same, the temperature levels at which stream 10 condenses and stream 16 boils are different. Due to the lower pressure of stream 10, the condensing temperature of stream 10 is significantly lower than the boiling temperature of stream 16. In order to be able to condense stream 10 there must be a liquid stream that boils at a slightly lower temperature than stream 10, and in order to be able to vaporize stream 16 there must be a vapor stream that condenses at a slightly higher temperature than stream 16. Both of these functions are provided by one fluid, a defined multicomponent refrigerant fluid, which provides both the boiling and the condensing streams at the required temperatures.

Higher pressure multicomponent refrigerant fluid in stream 30 is passed to the warm end of heat exchanger 60 at a pressure and having a composition such that the dew point of stream 30 is a few degrees higher than the bubble point of the pressurized oxygen liquid in stream 16. This allows the pressurized oxygen liquid in stream 16 to boil or vaporize by indirect heat exchange with the compressed multicomponent refrigerant fluid in stream 30. The resulting condensed higher pressure multicomponent refrigerant fluid is withdrawn from the cold end of heat exchanger 60 in stream 31 and is flashed to a lower pressure by passage through valve 32 to form stream 33 which is mostly liquid. The pressure of stream 33 is set such that its bubble point is slightly colder than the dew point of the low pressure oxygen gas in stream 10. This allows the multicomponent refrigerant fluid in stream 33 to boil or vaporize at the correct temperature to allow the low pressure oxygen gas in stream 10 to condense to form stream 11. Resulting vaporized multicomponent refrigerant fluid is withdrawn from the warm end of heat exchanger 60 in stream 34 and passed to compressor 35 wherein it is compressed to a level to achieve the afore described pressure requirements. The resulting higher pressure multicomponent refrigerant fluid 36 is cooled of the heat of compression by passage through cooler 37 to form the aforesaid higher pressure multicomponent refrigerant fluid 30 and the cycle starts anew.

Table 1 presents one illustrative example of the invention in accord with an embodiment such as is illustrated in FIG. 1 but without the use of a downstream cryogenic rectification column. That is, all of stream 11 is passed to the liquid pump and there are no other fluids passing through heat exchanger 60 other than those recited in Table 1. In Table 1 the stream numbers correspond to those of FIG. 1 and the compositions are in mole percent.

TABLE 1

| Stream | Flow mcfh | Pres. psia | Temp. deg. K | $N_2$ % | Argon % | $O_2$ % | Perf-C3 % | perf-C5 % |
|---|---|---|---|---|---|---|---|---|
| 10 | 50.0 | 20 | 300.0 | 5.0 | 5.0 | 90.0 | 0.0 | 0.0 |
| 11 | 50.0 | 18 | 90.5 | 5.0 | 5.0 | 90.0 | 0.0 | 0.0 |
| 15 | 50.0 | 152 | 90.9 | 5.0 | 5.0 | 90.0 | 0.0 | 0.0 |
| 18 | 0.0 | 152 | 90.9 | 5.0 | 5.0 | 90.0 | 0.0 | 0.0 |
| 16 | 50.0 | 152 | 90.9 | 5.0 | 5.0 | 90.0 | 0.0 | 0.0 |
| 17 | 50.0 | 150 | 297.4 | 5.0 | 5.0 | 90.0 | 0.0 | 0.0 |
| 30 | 65.0 | 300 | 300.0 | 38.0 | 59.0 | 0.0 | 1.0 | 2.0 |
| 31 | 65.0 | 298 | 90.5 | 38.0 | 59.0 | 0.0 | 1.0 | 2.0 |
| 33 | 65.0 | 18 | 83.9 | 38.0 | 59.0 | 0.0 | 1.0 | 2.0 |
| 34 | 65.0 | 16 | 297.4 | 38.0 | 59.0 | 0.0 | 1.0 | 2.0 |
| 36 | 65.0 | 301 | 388.0 | 38.0 | 59.0 | 0.0 | 1.0 | 2.0 |

Since it is desirable to have the pressure of stream 34 above atmospheric pressure, the choice of components for the multicomponent refrigerant fluid is important in determining the bubble point of this stream. Once the components have been chosen, the pressure of stream 30 is then set so that the dew point of this stream is slightly higher than the bubble point of stream 16. The flow of the multiple component refrigerant fluid stream is set so that the heat duty of the condensing and boiling streams matches that of the boiling and condensing oxygen fluid streams.

Preferably the multicomponent refrigerant fluid useful in the practice of this invention is a variable load refrigerant which comprises at least one atmospheric gas and at least one fluorocarbon. Most preferably the multicomponent refrigerant fluid comprises at least two atmospheric gases and/or at least two fluorocarbons. Most preferably the multicomponent refrigerant fluid comprises nitrogen ant argon and at least one fluorocarbon having at least 3 carbon atoms. Most preferably the multicomponent refrigerant fluid comprises from 20 to 80 mole percent argon and from 10 to 70 mole percent nitrogen. Most preferably the multicomponent refrigerant fluid comprises not more than 15 mole percent fluorocarbons.

In Tables 2–10 there are listed some particularly preferred embodiments of the multicomponent refrigerant fluid useful in the practice of this invention. The concentration range of the components is in mole percent.

TABLE 2

| COMPONENT | CONCENTRATION RANGE |
|---|---|
| $C_5F_{12}$ | 1–15 |
| $C_4F_{10}$ | 0–10 |
| $C_3F_8$ | 1–15 |
| $C_2F_6$ | 0–10 |
| $CF_4$ | 0–10 |
| $O_2$ | 0–20 |
| Ar | 20–80 |
| $N_2$ | 10–70 |

TABLE 3

| COMPONENT | CONCENTRATION RANGE |
|---|---|
| $C_3H_3F_5$ | 1–15 |
| $C_2H_2F_4$ | 0–10 |
| $C_3F_8$ | 1–15 |
| $CHF_3$ | 0–10 |
| $CF_4$ | 0–10 |
| $O_2$ | 0–20 |
| Ar | 20–80 |
| $N_2$ | 10–70 |

TABLE 4

| COMPONENT | CONCENTRATION RANGE |
|---|---|
| $C_3H_3F_5$ | 1–15 |
| $C_2H_2F_4$ | 0–10 |
| $C_2HF_5$ | 1–15 |
| $CHF_3$ | 0–10 |
| $O_2$ | 0–20 |
| Ar | 20–80 |
| $N_2$ | 10–70 |

TABLE 5

| COMPONENT | CONCENTRATION RANGE |
|---|---|
| $C_2HCl_2F_3$ | 1–15 |
| $C_2HClF_4$ | 0–10 |
| $C_2HF_5$ | 1–15 |
| $CHF_3$ | 0–10 |
| $O_2$ | 0–20 |
| Ar | 20–80 |
| $N_2$ | 10–70 |

TABLE 6

| COMPONENT | CONCENTRATION RANGE |
|---|---|
| $C_2HCl_2F_3$ | 1–15 |
| $C_2HClF_4$ | 0–10 |
| $C_3F_8$ | 1–15 |
| $C_2F_6$ | 0–10 |
| $CF_4$ | 0–10 |
| $O_2$ | 0–20 |
| Ar | 20–80 |
| $N_2$ | 10–70 |

TABLE 7

| COMPONENT | CONCENTRATION RANGE |
|---|---|
| $C_2HCl_2F_3$ | 1–15 |
| $C_2HClF_4$ | 0–10 |
| $C_3F_8$ | 1–15 |
| $CHF_3$ | 1–10 |
| $CF_4$ | 0–10 |
| $O_2$ | 0–20 |
| Ar | 20–80 |
| $N_2$ | 10–70 |

TABLE 8

| COMPONENT | CONCENTRATION RANGE |
|---|---|
| $CHF_2$—O—$C_2HF_5$ | 1–15 |
| $CF_3$—O—$C_3F_3$ | 1–10 |
| $CF_3$—O—$CF_3$ | 0–10 |
| $O_2$ | 0–20 |
| Ar | 20–80 |
| $N_2$ | 10–70 |

TABLE 9

| COMPONENT | CONCENTRATION RANGE |
|---|---|
| $CHF_2$—O—$C_2HF_5$ | 1–15 |
| $C_2HF_5$ | 1–10 |
| $CF_3$—O—$CF_3$ | 0–10 |
| $O_2$ | 0–20 |

TABLE 9-continued

| COMPONENT | CONCENTRATION RANGE |
|---|---|
| Ar | 20–80 |
| $N_2$ | 10–70 |

TABLE 10

| COMPONENT | CONCENTRATION RANGE |
|---|---|
| $CHF_2$—O—$C_2HF_5$ | 1–15 |
| $C_4F_{10}$ | 0–10 |
| $C_2HF_5$ | 1–15 |
| $CHF_3$ | 0–10 |
| $CF_4$ | 1–10 |
| $O_2$ | 0–20 |
| Ar | 20–80 |
| $N_2$ | 10–70 |

As mentioned, FIG. 1 illustrates a particularly preferred embodiment of the invention. Since one element of the invention involves the liquification of oxygen gas, a portion of such oxygen liquid may be conveniently processed in a cryogenic rectification column to produce high purity oxygen, i.e. a fluid having an oxygen concentration which exceeds that of the low pressure oxygen gas provided into the system.

Referring back now to FIG. 1, a portion 12 of oxygen liquid stream 11 is passed into cryogenic rectification column 61 which is operating at a pressure generally within the range of from 14.7 to 25 psia. Within column 61 the oxygen liquid provided into that column is separated by cryogenic rectification into high purity oxygen and into waste fluid. Some of the waste fluid is condensed in top condenser 63 to form column reflux. Another portion of the waste fluid is withdrawn from the upper portion of column 61 in vapor stream 50, warmed by passage through heat exchanger 60 and removed from the system in stream 51. Some of the high purity oxygen is boiled in bottom reboiler 62 to form column upflow vapor. Another portion of the high purity oxygen is withdrawn from the lower portion of the column 61 in stream 20 and pumped to a higher pressure in liquid pump 21 to form high pressure stream 22. If desired, a portion 25 of stream 22 may be recovered as high purity oxygen liquid. The remaining high pressure high purity oxygen liquid 23 is vaporized by passage through heat exchanger 60 and recovered as high purity oxygen gas. Typically the high purity oxygen fluid has an oxygen concentration of at least 99.5 mole percent.

Cryogenic rectification column 61 is driven by a heat pump circuit which includes top condenser 63 and bottom reboiler 62 and which uses a recirculating heat pump fluid which may be a pure component such as nitrogen or may be multicomponent refrigerant fluid such as those which are useful in the oxygen compression circuit described above. Compressed stream 48 is cooled of the heat of compression by passage through heat exchanger 60 to form stream 41. The pressure of stream 40 is set such that the dew point temperature of stream 40 is slightly higher than the bubble point temperature of the liquid at the bottom of column 61. This allows stream 41 to condense in reboiler 62 while providing the heat duty required for boil up in the column. Condensed stream 42 is then reduced in pressure through throttle valve 43 to form stream 44, with the pressure of stream 44 set such that the bubble point of stream 44 is slightly lower than the dew point of the overhead products of column 61. Vapor stream 45 is then warmed in heat exchanger 60 and resulting stream 46 is passed to compressor 47 for compression to the pressure required by stream 40.

Figure 2:
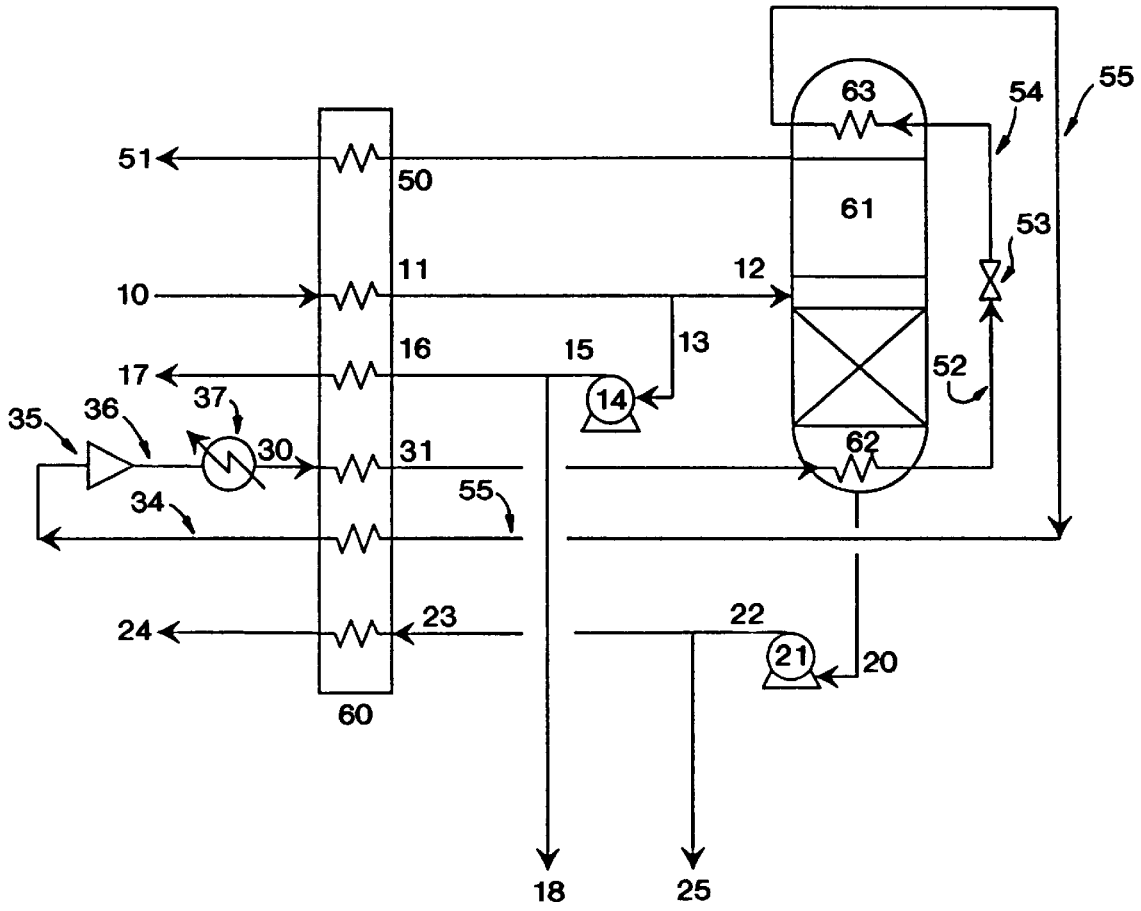
FIG. 2 is a schematic representation of another particularly preferred embodiment of the invention wherein some oxygen liquid is further processed in a cryogenic rectification column driven by a heat pump circuit integrated with the multicomponent refrigerant fluid circuit.

FIG. 2 illustrates another particularly preferred embodiment of the invention, which is similar to the embodiment illustrated in FIG. 1 except that the multicomponent refrigerant fluid which is used to produce the pressurized oxygen gas is also used as the heat pump fluid to drive the cryogenic rectification column. The numerals of FIG. 2 are the same as those of FIG. 1 for the common elements, and these common elements will not be described again in detail.

Referring now to FIG. 2, multicomponent refrigerant fluid 30 is mostly condensed in heat exchanger 30 and resulting stream 31 is passed to bottom reboiler 62 wherein the uncondensed portion of stream 31 is condensed to provide the heat duty needed for column 61 boil up. Resulting liquid multicomponent fluid in stream 52 is throttled through valve 53 and then passed as stream 54 to top condenser 63 wherein a portion of stream 54 is vaporized to provide the heat duty needed to generate reflux for column 61. The resulting mostly liquid, low pressure multicomponent fluid in stream 55 is then passed to heat exchanger 60 wherein it is vaporized to carry out the condensation of low pressure oxygen gas. The resulting vaporized multicomponent refrigerant fluid in stream 34 is passed to compressor 35 and processed as previously described.

Now by the use of this invention, one can effectively and efficiently produce pressurized oxygen gas from low pressure oxygen gas without the need for compressing the oxygen gas. Although the invention has been described in detail with reference to certain particularly preferred embodiments, those skilled in the art will recognize that there are other embodiments of the invention within the spirit and the scope of the claims.

What is claimed is:

1. A method for producing pressurized oxygen gas comprising:

(A) condensing low pressure oxygen gas by indirect heat exchange with vaporizing multicomponent refrigerant fluid to produce low pressure oxygen liquid and vaporized multicomponent refrigerant fluid;

(B) pumping at least some of the low pressure oxygen liquid to produce pressurized oxygen liquid, and compressing the vaporized multicomponent refrigerant fluid to produce higher pressure multicomponent refrigerant fluid; and (C) vaporizing at least some of the pressurized oxygen liquid by indirect heat exchange with condensing higher pressure multicomponent refrigerant fluid to produce condensed higher pressure multicomponent refrigerant fluid and pressurized oxygen gas.

2. The method of claim 1 further comprising passing a portion of the oxygen liquid into a cryogenic rectification column, producing high purity oxygen by cryogenic rectification within the cryogenic rectification column, and recovering high purity oxygen from the lower portion of the cryogenic rectification column.

3. The method of claim 2 wherein reflux liquid for the cryogenic rectification column is provided by condensing column vapor by indirect heat exchange with a heat pump fluid, and upflow vapor for the cryogenic rectification column is provided by vaporizing column liquid by indirect heat exchange with said heat pump fluid.

4. The method of claim 1 wherein the heat pump fluid is said multicomponent refrigerant fluid.

5. The method of claim 1 wherein the multicomponent refrigerant fluid is a variable load refrigerant and comprises nitrogen and argon.

6. Apparatus for producing pressurized oxygen gas comprising:

(A) a heat exchanger, means for providing oxygen gas to the heat exchanger, a liquid pump, means for passing oxygen liquid from the heat exchanger to the liquid pump, and means for passing oxygen liquid from the liquid pump to the heat exchanger;

(B) a compressor, means for passing multicomponent refrigerant fluid from the heat exchanger to the compressor, and means for passing multicomponent refrigerant fluid from the compressor to the heat exchanger; and (C) means for recovering product pressurized oxygen gas from the heat exchanger.

7. The apparatus of claim 6 further comprising a cryogenic rectification column, means for passing oxygen liquid from the heat exchanger to the cryogenic rectification column, and means for recovering product from the lower portion of the cryogenic rectification column.

8. The apparatus of claim 7 wherein the cryogenic rectification column includes a top condenser and a bottom reboiler, and further comprising a heat pump circuit comprising means for passing heat pump fluid from the heat exchanger to the bottom reboiler, from the bottom reboiler to the top condenser, and from the top condenser back to the heat exchanger.

9. The apparatus of claim 8 wherein the heat pump circuit is in flow communication with the means for passing multicomponent refrigerant fluid from the heat exchanger to the compressor and from the compressor to the heat exchanger.

10. The apparatus of claim 6 wherein the heat exchanger is a unitary piece.

* * * * *

UNITED STATES PATENT AND TRADEMARK OFFICE

CERTIFICATE OF CORRECTION

PATENT NO. : 6,178,776 B1
DATED : January 30, 2001
INVENTOR(S) : Mahoney et al.

It is certified that error appears in the above-identified patent and that said Letters Patent is hereby corrected as shown below:

Column 5,
Line 33, between “nitrogen” and “argon” delete “ant” and insert therefor -- and --.

Column 8,
Line 66, delete “1” and insert therefor -- 3 --.

Signed and Sealed this

Twenty-sixth Day of November, 2002

*Attest:*

*Attesting Officer*

JAMES E. ROGAN
*Director of the United States Patent and Trademark Office*